US005169138A

United States Patent [19]

Cordes

[11] Patent Number: 5,169,138

[45] Date of Patent: Dec. 8, 1992

[54] ADJUSTABLE DECK SYSTEM

[75] Inventor: LeRoy J. Cordes, Brookfield, Conn.

[73] Assignee: Pitney Bowes Inc., Stamford, Conn.

[21] Appl. No.: 800,314

[22] Filed: Nov. 29, 1991

[51] Int. Cl.[5] ..... B65H 1/00

[52] U.S. Cl. ..... 271/145; 193/22; 193/23; 271/225; 271/184

[58] Field of Search ..... 271/145, 184, 207, 213, 271/225, 226, 248; 193/22, 23

[56] References Cited

U.S. PATENT DOCUMENTS 4,529,190 7/1985 Goodwin et al. ..... 271/213
4,605,211 8/1986 Sonobe ..... 271/207 X

FOREIGN PATENT DOCUMENTS 0002575 1/1980 Japan ..... 271/207

*Primary Examiner*—H. Grant Skaggs

*Assistant Examiner*—Carol Lynn Druzbick

*Attorney, Agent, or Firm*—Charles R. Malandra, Jr.; Melvin J. Scolnick

[57] ABSTRACT

An adjustable deck system including: a first, stationary deck; a second, rotatable deck partially overlying and pivotably mounted to the stationary deck; and a device for rotating the rotatable deck relative to the stationary deck. The rotating device includes: a pair of support brackets spaced from each other and secured to the stationary deck; a first shaft fixedly secured at its ends to the pair of support brackets; a traveling block slidably mounted on the shaft; a device for moving the block along the shaft; and a link pivotably secured at one end to the block and at its other end to the rotatable deck, whereby when the block is caused to move along the shaft, the link causes the rotatable deck to rotate with respect to the stationary deck.

3 Claims, 3 Drawing Sheets

ADJUSTABLE DECK SYSTEM

BACKGROUND OF THE INVENTION

The instant invention relates to a pair of decks, one partially overlying the other, and more particularly to such a pair of decks and apparatus for aligning one deck relative to the other deck.

Many paper handling machines employ modules which are connected together by the user in order to create an assembly line for processing the paper; a typical example might be a document feeding machine which is connected to a folding machine. With such connected modules, it is frequently critical that the decks of each of the modules be absolutely in alignment so that the paper enters the downstream module in proper alignment. One of the modules will typically have a fixed deck position while the other module has a deck which is adjustable relative to the fixed deck position.

When adjacent modules are connected together, it is typically accomplished by overlapping the deck of one module onto the deck of the other module. The decks must be aligned so that the path of travel of the documents in one module is absolutely parallel to the path of travel in the adjacent module. Because the modules are connected together by the operator thereof, the alignment of the modules cannot be pre-set by the manufacturer of the modules. Accordingly, the alignment of the modules must be effected by the operator.

The instant invention thus provides apparatus that will enable an operator to align two paper handling modules so that their paper paths are absolutely parallel; the alignment apparatus also can be used to align any two overlapping surfaces or decks where precise alignment is a requirement.

SUMMARY OF THE INVENTION

Accordingly, the instant invention provides an adjustable deck system, comprising: a first, stationary deck; a second, rotatable deck partially overlying and pivotably mounted to said stationary deck; and means for rotating the rotatable deck relative to the stationary deck. The rotating means includes: a pair of support brackets spaced from each other and secured to the stationary deck; a first shaft fixedly secured at its ends to the pair of support brackets; a traveling block slidably mounted on the shaft; means for moving the block along the shaft; and a link pivotably secured at one end to the block and at its other end to the rotatable deck, whereby when the block is caused to move along the shaft, the link causes the rotatable deck to rotate with respect to the stationary deck.

DETAILED DESCRIPTION OF THE PREFERRED EMBODIMENT

Figure 1:
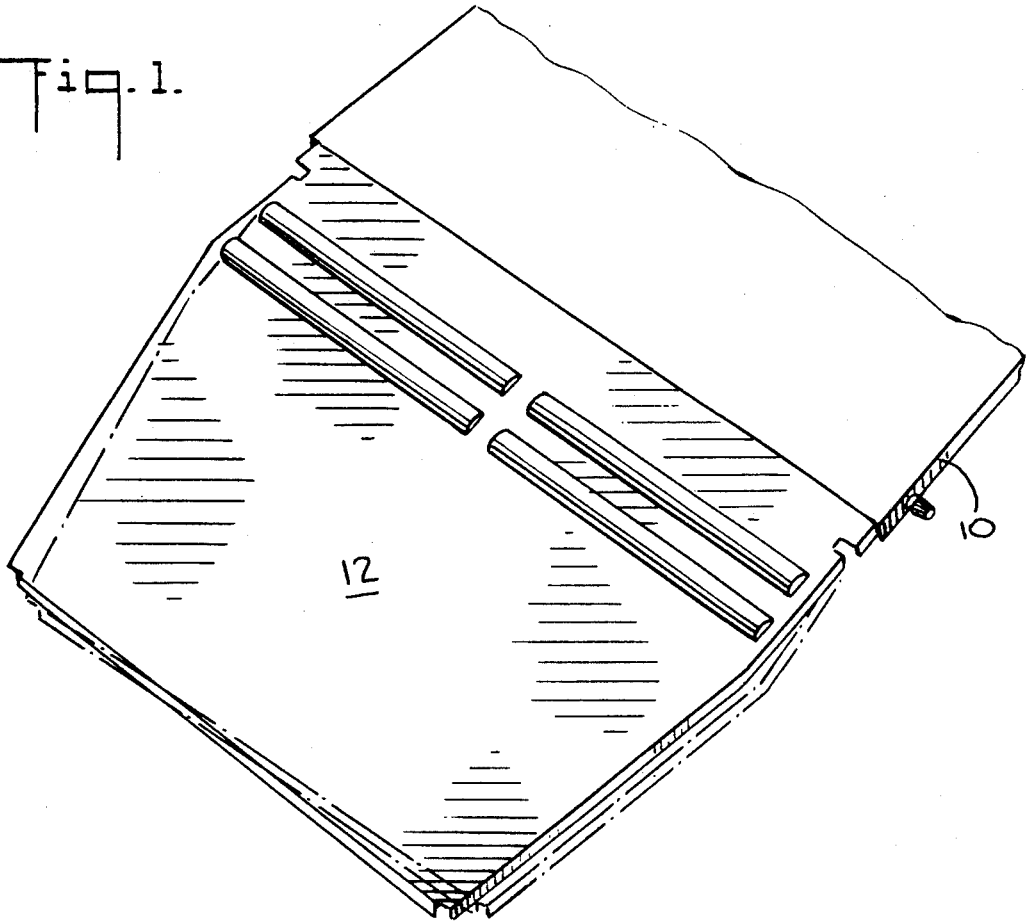
FIG. 1 is a perspective view of a pair of adjacent decks employing an alignment adjustment system in accordance with the instant invention.
Figure 3:
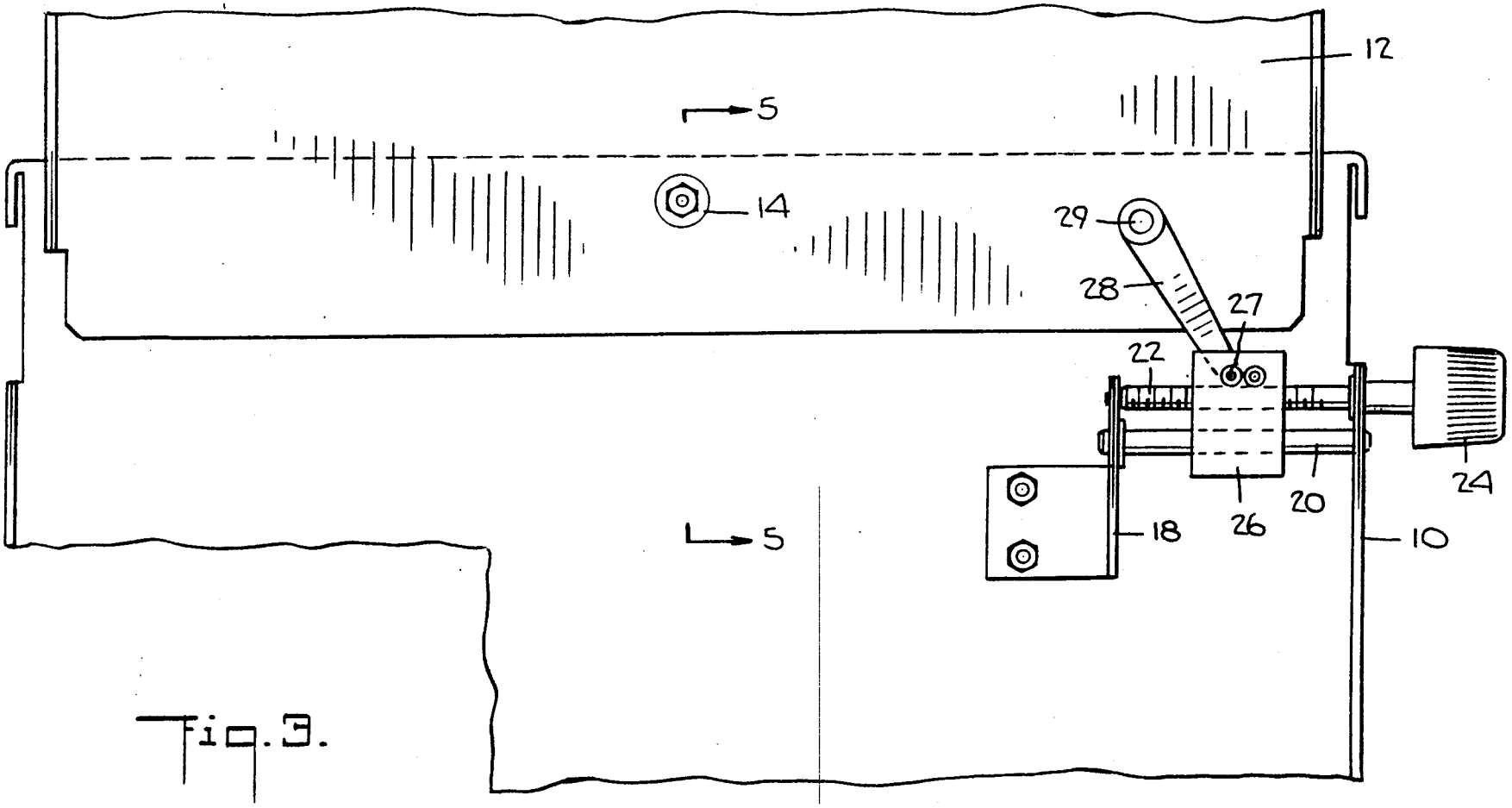
FIG. 3 is a bottom, plan view of the decks seen in FIG. 1.

In describing the preferred embodiment of the instant invention, reference is made to the drawings wherein there is seen a first, stationary deck 1O and an adjacent, adjustable, removable deck 12 (see FIGS. 1 and 3) pivotably secured to the stationary deck 10 with a pin 14. The decks are part of paper handling modules, such as feeders or folders, which are not shown, but which are conventional in the art.

Figure 2:
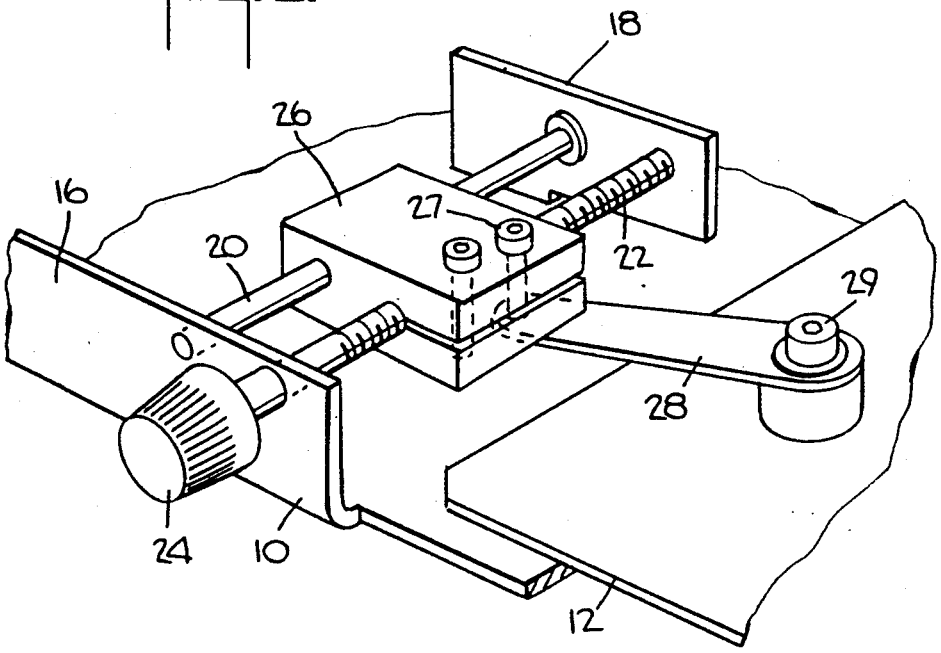
FIG. 2 is a perspective view of the decks seen in FIG. 1 turned upside down and showing the mechanical linkage of the adjustment system.

Reference is now made to the underside of the decks 10 and 12, as seen in FIG. 2, wherein there is seen a bracket flange 16 extending perpendicular from the fixed deck 10 and a supporting bracket 18 secured to the underside of the deck 10. A shaft 20 is fixedly secured at its ends to the flange 16 and the bracket 18. Extending parallel to the shaft 20 is a threaded shaft 22 rotatably mounted at its ends in the flange 16 and the bracket 18. A knob 24 is fixedly secured to one end of the threaded shaft 22 adjacent the flange 16 and remote from the bracket 18. A traveling block 26 threadingly engages the threaded shaft 22 and is slidably mounted on the fixed shaft 20. Extending horizontally from the traveling block 26 is a link 28 pivotably secured to the block 26 with a pin 27 at one end and to the adjustable deck 12 at its other end with a pin 29.

Figure 4:
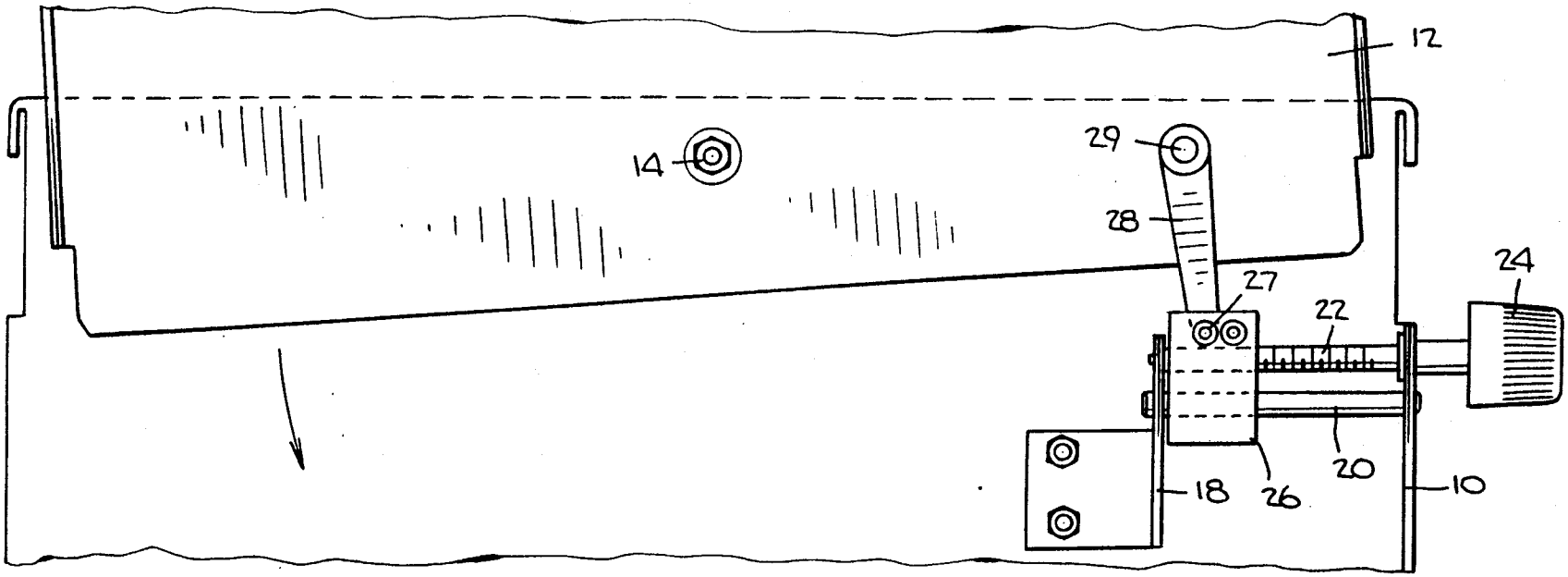
FIG. 4 is similar to FIG. 3 but shows the movable deck rotated counter-clockwise with respect to the fixed deck from the position see in FIG. 3.
Figure 5:
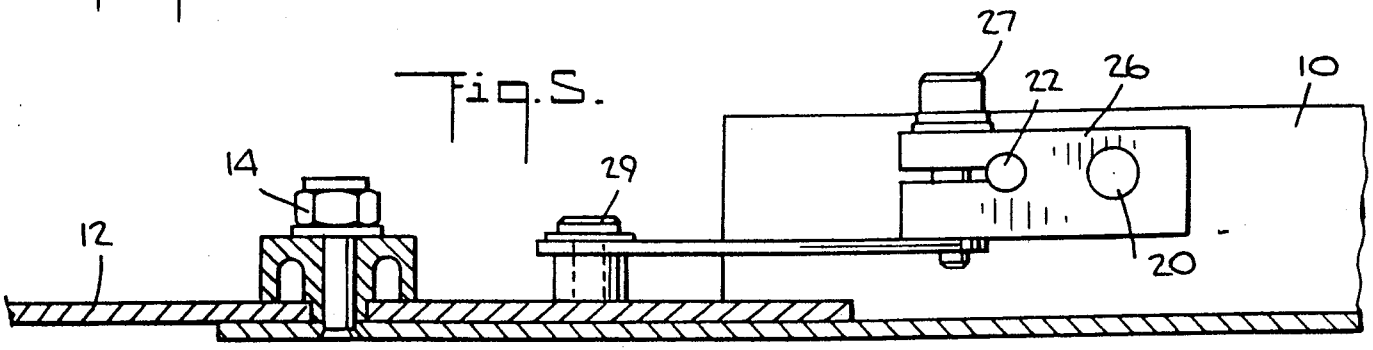
FIG. 5 is a sectional view taken on the plane indicated by the line 5—5 in FIG. 3.

The adjustable deck 12 can be rotated with respect to the fixed deck 10 by means of the operator of the modules comprising the decks 10 and 12 simply rotating the knob 24 clockwise or counterclockwise. A counterclockwise rotation of the knob 24 will cause the block 26 to travel away from the knob 24 which, looking at FIG. 3, effects a clockwise rotation of the link 28 about the pin 29, which in turn causes the adjustable deck 12 to rotate counter-clockwise about the pin 14, i.e. to move from the position seen in FIG. 3 to the position seen in FIG. 4. A clockwise rotation of the knob 24 will cause an opposite effect.

It can be seen that the adjustable deck 12 can be rotated about the pin 14 by a rotation of the knob 24 and hence aligned with respect to the fixed deck 10. As long as the decks 10 and 12 include overlapping portions which are substantially parallel, the linkage system described hereinabove can be used to fine tune the alignment of the decks 10 and 12 so that their respective modules can be properly aligned and process the paper being handled accurately and reliably.

It should be understood by those skilled in the art that various modifications may be made in the present invention without departing from the spirit and scope thereof, as described in the specification and defined in the appended claims.

What is claimed is:

1. An adjustable deck system, comprising:

a first, stationary deck;

a second, rotatable deck partially overlying and pivotably mounted to said first deck; and means for rotating said rotatable deck relative to said stationary deck, said rotating means including a. a pair of support brackets spaced from each other and secured to said stationary deck, b. a first shaft fixedly secured at its ends to said pair of support brackets, c. a traveling block slidably mounted on said shaft, d. means for moving said block along said shaft, and e. a link pivotably secured at one end to said block and at its other end to said rotatable deck, whereby when said block is caused to move along said shaft, said link causes said rotatable deck to rotate with respect to said stationary deck.

2. The deck system of claim 1, wherein said moving means comprises a threaded shaft rotatably mounted at its end in said support brackets and said block threadingly engages said threaded shaft.

3. The deck system of claim 2, additionally comprising a knob fixedly secured to one end of said threaded shaft, whereby rotation of said knob causes said block to move along said first shaft and said threaded shaft.

* * * * *